US007567244B2

(12) United States Patent
Nohtomi et al.

(10) Patent No.: US 7,567,244 B2
(45) Date of Patent: Jul. 28, 2009

(54) SEMICONDUCTOR INTEGRATED CIRCUIT FOR DRIVING A LIQUID CRYSTAL DISPLAY

(75) Inventors: Shinobu Nohtomi, Nanae (JP); Toshikazu Tachibana, Nanae (JP); Shinya Suzuki, Nanae (JP); Kazuo Okada, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 660 days.

(21) Appl. No.: 11/395,177

(22) Filed: Apr. 3, 2006

(65) Prior Publication Data

US 2006/0227091 A1 Oct. 12, 2006

(30) Foreign Application Priority Data

Apr. 6, 2005 (JP) ..... 2005-109535

(51) Int. Cl.
*G09G 3/36* (2006.01)

(52) U.S. Cl. ..... 345/204; 345/89; 345/103; 345/205; 345/206; 345/210; 345/211

(58) Field of Classification Search ..... 345/89, 345/99, 100, 103, 204, 205, 206, 210, 211
See application file for complete search history.

(56) References Cited

U.S. PATENT DOCUMENTS 5,623,279 A * 4/1997 Itakura et al. ..... 345/98
5,973,660 A * 10/1999 Hashimoto ..... 345/98
5,995,073 A * 11/1999 Isami et al. ..... 345/89
2006/0022925 A1 * 2/2006 Hara et al. ..... 345/89

FOREIGN PATENT DOCUMENTS

JP 10-62744 3/1998

* cited by examiner

*Primary Examiner*—Bipin Shalwala
*Assistant Examiner*—Vince E Kovalick
(74) *Attorney, Agent, or Firm*—Miles & Stockbridge P.C.

(57) ABSTRACT

A semiconductor integrated circuit for driving a liquid crystal display, capable of improving the quality of an image displayed by preventing an imbalance between the outputs of a pair of amplifiers for positive voltage and negative voltage for AC driving of the liquid crystal panel and transmission of noise from one amplifier to the other amplifier is realized. A driver circuit that generates and outputs dive signals to be applied to signal lines of the liquid crystal panel includes decoder circuits, each of which selects a gray-scale voltage corresponding to image data. It also includes amplifiers for positive voltage which perform impedance conversion of positive voltages selected by the decoder circuits and amplifiers for negative voltage which perform impedance conversion of negative voltages selected by the decoder circuits. Furthermore, it includes an AC output section consisting of switch circuits, each of which alternately conducts an output of each amplifier for positive voltage to one of two adjacent output terminals and an output of each amplifier for negative voltage to the other one of the two adjacent terminals and vice versa. Two pairs of supply voltages having the same potential difference are generated as supply voltages to the amplifiers for positive voltage and the amplifiers for negative voltage and supplied through separate power supply lines.

10 Claims, 8 Drawing Sheets

FIG. 4(A)

| | S1 | S2 | S3 | S4 | S5 | S6 | S7 | S8 |
|---|---|---|---|---|---|---|---|---|
| G1 | + | − | + | − | + | − | + | − |
| G2 | − | + | − | + | − | + | − | + |
| G3 | + | − | + | − | + | − | + | − |
| G4 | − | + | − | + | − | + | − | + |
| G5 | + | − | + | − | + | − | + | − |
| G6 | − | + | − | + | − | + | − | + |
| G7 | + | − | + | − | + | − | + | − |
| G8 | − | + | − | + | − | + | − | + |

AC DRIVING PER FRAME

FIG. 4(B)

| | S1 | S2 | S3 | S4 | S5 | S6 | S7 | S8 |
|---|---|---|---|---|---|---|---|---|
| G1 | − | + | − | + | − | + | − | + |
| G2 | + | − | + | − | + | − | + | − |
| G3 | − | + | − | + | − | + | − | + |
| G4 | + | − | + | − | + | − | + | − |
| G5 | − | + | − | + | − | + | − | + |
| G6 | + | − | + | − | + | − | + | − |
| G7 | − | + | − | + | − | + | − | + |
| G8 | + | − | + | − | + | − | + | − |

FIG. 5(A)

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | + | − | + | − | + | − | + | − |
| G4 | + | − | + | − | + | − | + | − |
| G5 | + | − | + | − | + | − | + | − |
| G6 | + | − | + | − | + | − | + | − |
| G7 | + | − | + | − | + | − | + | − |
| G8 | + | − | + | − | + | − | + | − |

AC DRIVING PER FRAME

FIG. 5(B)

| | S1 | S2 | S3 | S4 | S5 | S6 | S7 | S8 |
|---|---|---|---|---|---|---|---|---|
| G1 | − | + | − | + | − | + | − | + |
| G2 | − | + | − | + | − | + | − | + |
| G3 | − | + | − | + | − | + | − | + |
| G4 | − | + | − | + | − | + | − | + |
| G5 | − | + | − | + | − | + | − | + |
| G6 | − | + | − | + | − | + | − | + |
| G7 | − | + | − | + | − | + | − | + |
| G8 | − | + | − | + | − | + | − | + |

SEMICONDUCTOR INTEGRATED CIRCUIT FOR DRIVING A LIQUID CRYSTAL DISPLAY

CROSS-REFERENCE TO RELATED APPLICATION

The present application claims priority from Japanese patent application No. 2005-109535 filed on Apr. 06, 2005, the content of which is hereby incorporated by reference into this application.

BACKGROUND OF THE INVENTION

The present invention relates to a liquid crystal display (LCD) device that drives a liquid crystal panel and, in particular, to a technique that is effectively applicable to an LCD-driving large scale integration (LSI) (large-scale semiconductor integrated circuit) including a driver circuit that dives signal lines to the liquid crystal display panel by AC voltage.

Lately, a dot matrix type liquid crystal panel in which a plurality of display pixels are arranged in a two-dimensional array, for example, in a matrix is generally used as a display device of portable electronic devices such as mobile phones and Personal Digital Assistants. Inside these devices, a display control device implemented in a semiconductor integrated circuit for performing display control of this liquid crystal panel and a driver circuit for driving the liquid crystal panel or the display control device including such driver circuit are installed.

The internal circuit of such display control device implemented in a semiconductor integrated circuit can operate on a low voltage of 5 V or less, whereas a high voltage such as 5-40 V is required to drive the display of the liquid crystal panel. For this reason, in the display control device, a driver circuit and an output circuit which operate on a voltage boosted from a supply voltage are provided and a level shifter circuit is provided between the internal logic operating on a voltage of 5 V or less and the driver circuit operating on the boosted voltage.

Because continuous application of DC voltage to liquid crystal deteriorates the liquid crystal, a liquid crystal panel driver must drive the panel by AC voltage. For such driving by AC voltage, there exists a liquid crystal driver circuit in which an amplifier operating on a positive supply voltage and an amplifier operating on a negative supply voltage are provided for each output terminal, adapted to output an AC drive signal by alternately connecting the positive and negative amplifiers to one output terminal. As an invention relating to the thus configured liquid crystal driver circuit, there exits the one described, for example, in patent document 1.

[Patent document 1] Japanese Unexamined Patent Publication No. Hei 10(1998)-062744

SUMMARY OF THE INVENTION

By the way, it is known that a circuit operating on a high voltage consumes larger power than a circuit operating on a low voltage. Recently, semiconductor integrated circuits that operate on a lower supply voltage have been evolved with an intention to decrease power consumption and increase circuit speed. However, a semiconductor integrated circuit including a circuit operating on a high voltage like a liquid crystal driver circuit must have high voltage tolerant elements to constitute the circuit operating on a high voltage. In general, high voltage tolerant elements have a drawback of lower operating speed than low voltage tolerant elements. Meanwhile, to decrease power consumption and increase speed, the internal circuit of a display control device is designed to be comprised of low voltage tolerant elements, so that the circuit will operate on a low operating supply voltage. However, such semiconductor integrated circuit wherein high voltage tolerant elements and low voltage tolerant elements coexist has a problem in which its manufacturing process becomes complicated, resulting in a cost increase.

Even in the above-mentioned invention of a prior application, wherein both amplifiers for positive voltage and amplifiers for negative voltage are provided, by making the amplifiers for positive voltage operate on supply voltages of VLCD and ½ VLCD and the amplifiers for negative voltage operate on supply voltages of ½ VLCD and 0 V, power consumption can be decreased and the most use of low voltage tolerant elements can be made, as compared with when both amplifiers commonly operate on supply voltages of VLCD and 0V.

However, in the above-mentioned invention of a prior application, the amplifiers for positive voltage and the amplifiers for negative voltage use one common supply voltage of ½ VLCD. Consequently, the following problems would be posed: a shift in the ½ VLCD level reflects an imbalance between the output amplitudes of a pair of the amplifiers for positive voltage and negative voltage; and noise generated by operation of one amplifier is transmitted through a common power line to the other amplifier, which causes a deterioration in the quality of an image displayed.

An object of this invention is to decrease power consumption of a liquid crystal display driver device implemented in a semiconductor integrated circuit for driving the liquid crystal panel and to enable chip size reduction of that device, consequently, cost reduction, by allowing for the most use of low voltage tolerant element structures and processes with low voltage tolerant elements.

Another object of this invention is to improve the quality of an image displayed by preventing an imbalance between the output amplitudes of a pair of the amplifiers for positive voltage and negative voltage for AC driving of the liquid crystal panel and transmission of noise from one amplifier to the other amplifier in the liquid crystal display driver device implemented in a semiconductor integrated circuit for driving the liquid crystal panel.

The above and other objects and novel features of this invention will become apparent from the description of the present specification and the accompanying drawings.

A typical aspect of the invention disclosed herein will be summarized below.

In a semiconductor integrated circuit for driving a liquid crystal display, including a driver circuit which generates and outputs drive signals which have gray-scale voltages corresponding to image data to be displayed and should be applied to signal lines of an active matrix type liquid crystal panel, the driver circuit includes decoder circuits, each of which selects a gray-scale voltage corresponding to image data. The driver circuit also includes first differential amplifier circuits (amplifiers for positive voltage) which perform impedance conversion of positive voltages selected by the decoder circuits and second differential amplifier circuits (amplifiers for negative voltage) which perform impedance conversion of negative voltages selected by the decoder circuits. Furthermore, the driver circuit includes switch circuits, each of which alternately conducts an output of each amplifier for positive voltage to one of two adjacent output terminals and an output of each amplifier for negative voltage to the other one of the two adjacent terminals and vice versa. The driver circuit is configured such that two pairs of supply voltages having the same potential difference are generated as supply voltages to the amplifiers for positive voltage and the amplifiers for negative voltage and supplied through separate power supply lines.

By the above means, the amplifiers for positive voltage and the amplifiers for negative voltage can be made to operate on the supply voltages with a smaller potential difference than when they operate on common supply voltages. Therefore, power consumption can be decreased and the amplifiers can be configured with low voltage tolerant elements. Thereby, chip size reduction; consequently, cost reduction can be achieved. Since the two pairs of supply voltages having the same potential difference are generated as the supply voltages to the amplifiers for positive voltage and the amplifiers for negative voltage and supplied through separate power supply lines, an imbalance between the output amplitudes of a pair of the amplifiers for positive voltage and negative voltage and transmission of noise from one amplifier to the other amplifier can be prevented.

Effects that will be achieved by a typical aspect of the invention disclosed herein will be briefly described below.

According to the present invention, the power consumption of a liquid crystal display driver device implemented in a semiconductor integrated circuit for driving the liquid crystal panel is decreased. In addition, chip size reduction of that device, consequently, cost reduction, can be achieved by allowing for the most use of low voltage tolerant element structures and processes with low voltage tolerant elements.

According to the present invention, there is provided an effect capable of improving the quality of an image displayed by preventing an imbalance between the output amplitudes of a pair of the amplifiers for positive voltage and negative voltage for AC driving of the liquid crystal panel and transmission of noise from one amplifier to the other amplifier in the liquid crystal display driver device implemented in a semiconductor integrated circuit for driving the liquid crystal panel.

BRIEF DESCRIPTION OF THE DRAWINGS

FIG. 4 illustrates how the polarities of the pixels change when the liquid crystal panel is driven by a dot inversion method.

FIG. 5 illustrates how the polarities of the pixels change when the liquid crystal panel is driven by a column inversion method.

FIGS. 7A and 7B show the structures of elements (MOSFETs) used in the liquid crystal display control driver IC of the present embodiment, in which FIG. 7A is a cross-sectional view showing the structure of a high voltage tolerant element and FIG. 7B is a cross-sectional view showing the structure of a low voltage tolerant element.

FIGS. 8A and 8B show circuit diagrams of level shifter circuits, in which FIG. 9A shows a concrete example of a level shifter circuit for positive voltage and FIG. 9*b* shows a concrete example of a level shifter circuit for negative voltage.

DETAILED DESCRIPTION OF THE PREFERRED EMBODIMENTS

Preferred embodiments of the present invention will be described hereinafter, based on the drawings.

Figure 1:
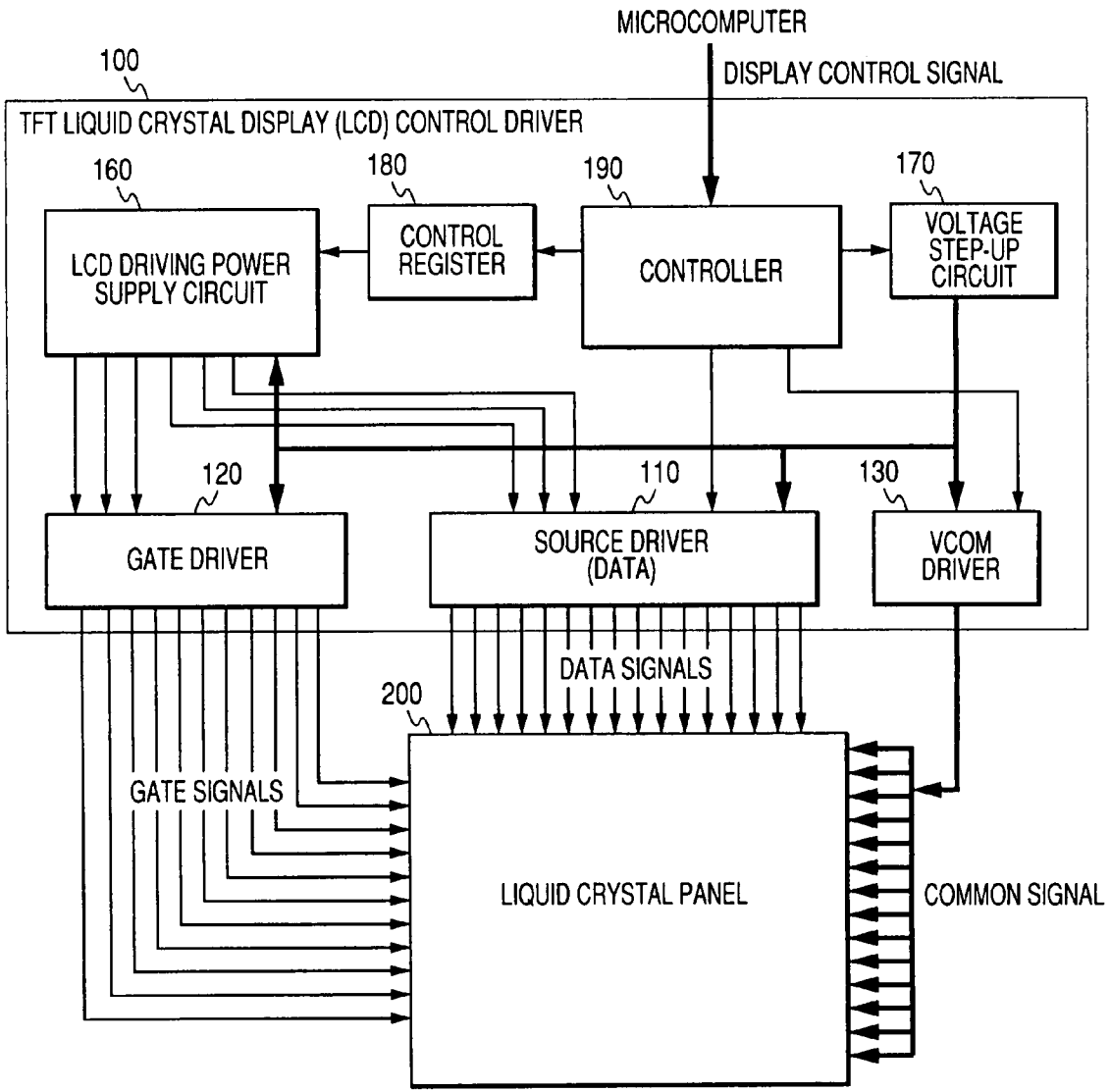
FIG. 1 is a block diagram showing an outlined structure of a liquid crystal display system comprising a semiconductor integrated circuit for driving the liquid crystal display (liquid crystal display control driver IC) to which the present invention is effectively applicable and a liquid crystal panel which is driven by the driver IC.

FIG. 1 shows an outlined structure of a liquid crystal display system comprising a semiconductor integrated circuit for driving the liquid crystal display (liquid crystal display control driver IC) to which the present invention is effectively applicable and a liquid crystal panel which is driven by the driver IC.

As shown in FIG. 1, the liquid crystal display control driver IC 100 of this embodiment includes a source driver circuit 110 which generates and outputs data signals to be applied to source lines of the liquid crystal panel 200, a gate driver circuit 120 which generates and outputs gate signals to be applied to the gate lines of the liquid crystal panel, and a common driver circuit 130 which generates and outputs gate signals to be applied to common electrodes of the liquid crystal panel.

Also, the liquid crystal display control driver IC 100 of this embodiment comprises: a liquid crystal display driving power supply circuit 160 which generates gray-scale voltages for use in the source driver circuit 110 and the gate driver circuit 120 and a constant voltage as the reference voltage for the gray-scale voltages; and a voltage step-up circuit 170 which generates a stepped-up voltage for use in each driver circuit. Also, the liquid crystal display control driver IC 100 includes: a control register 180 for specifying the amplitude and characteristic of a gray-scale voltage which is generated by the liquid crystal display driving power supply circuit 160; and a controller 190 or the like which receives a command and image data to be displayed from a microcomputer external to the chip, generates a control signal for the internal circuits, and manipulates the image data. Although not shown in FIG. 1, a Random Access Memory (RAM) may be provided for storing image data supplied from a system control device such as the external microcomputer.

Next, the structure of the TFT liquid crystal panel 200 that is driven by the liquid crystal display control driver IC to which the present invention is applied will be described, using FIG. 2.

Figure 2:
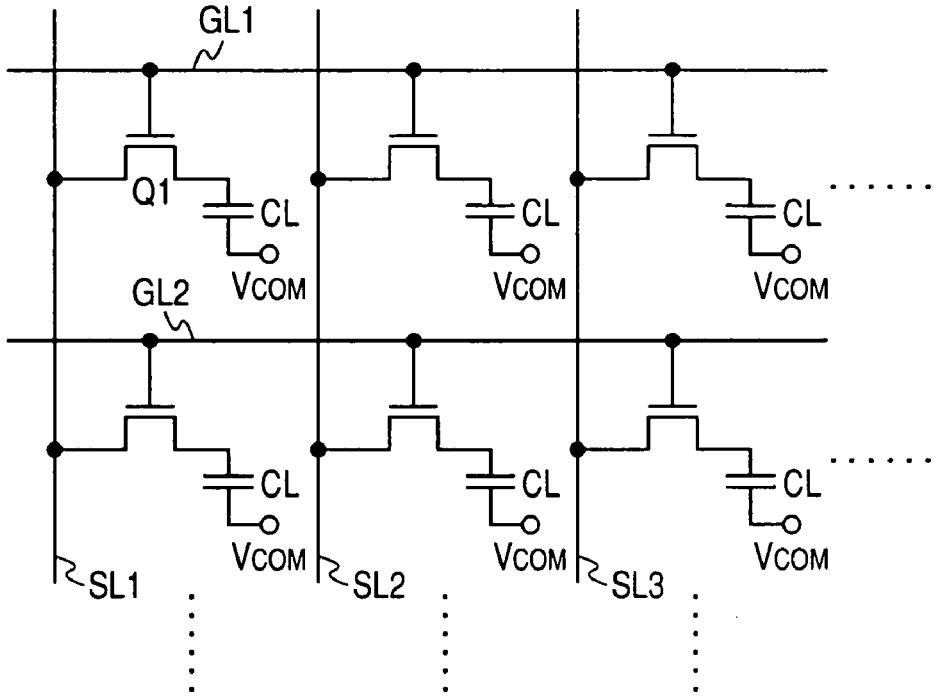
FIG. 2 is a block diagram showing the structure of the TFT liquid crystal panel that is driven by the liquid crystal display control driver IC to which the present invention is effectively applicable.

On the liquid crystal panel 200, as shown in FIG. 2, source lines (source electrodes) SL1, SL2, SL3 . . . as a plurality of signal lines to which image signals are applied and gate lines (gate electrodes) GL1, GL2, . . . as a plurality of scanning lines which are selected and driven sequentially at given intervals are arranged such that the source lines and the gate lines intersect with each other. At the intersections of the source lines SL1, SL2, SL3 . . . and the gate lines GL1, GL2, . . . pixels are disposed.

Each pixel consists of a thin film transistor (TFT) Q1 whose gate terminal is connected to any scanning line and whose source terminal is connected to any signal line, wherein the TFT Q1 is an element that is selected, and a pixel capacitance CL connected between the drain terminal of the TFT and the opposing electrode which gives a center potential of the liquid crystal (COM potential) VCOM and is common for all pixels. These pixels are disposed at the intersections of the sources lines and the gate lines and constitute the active matrix type panel.

The pixels are divided into those for R (red), those for G (green), and those for B (blue) and these pixels are arranged in order of R, G, and B, for example. The colors of the pixels are given by color filters formed on the opposing substrate. The liquid crystal is sandwiched between one electrode (pixel electrode) of the pixel capacitance CL connected to the drain terminal of the TFT Q1 and the opposing electrode and its polarization factor changes according to the potential difference between the potential of the pixel electrode and the COM potential, which in turn changes the luminance of the pixel, thus effecting a gray-scale display.

Figure 3:
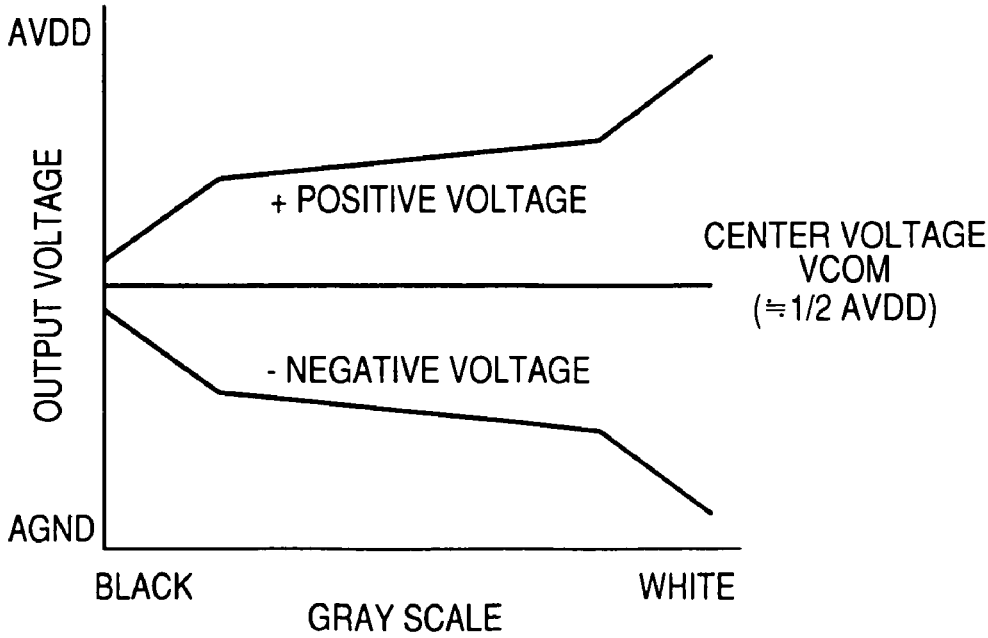
FIG. 3 illustrates a relationship between a positive voltage and a negative voltage which are applied to a pixel electrode and a gray scale.

However, because continuous application of DC voltage to the liquid crystal deteriorates the liquid crystal, AC voltages must be applied to the source lines and gate lines to drive the pixels. FIG. 3 shows a relationship between positive and negative voltages that are applied to the pixel electrode and the gray scale. If a pixel is made to continue to have a same gray level on the liquid crystal panel, it is AC driven by alternately selecting and supplying the potentials corresponding to the same gray level above and below the center potential VCOM in FIG. 3 to the pixel electrode.

For AC driving of the liquid crystal panel, two methods are used: a dot inversion method in which the polarities of the pixels are inversed frame by frame so that the polarities of the up, down, right and left pixels adjacent to a pixel will be opposite to the polarity of the pixel, as is shown in FIG. 4; and a column inversion method in which the polarities of the pixels are inversed frame by frame so that the polarities of the right and left pixels adjacent to a pixel will be opposite to the polarity of the pixel, as is shown in FIG. 5. The driver circuit to drive the source lines of the liquid crystal panel can be configured to enable driving in either the dot inversion method or the column inversion method simply by changing the timing of a polarity switchover of the voltage to be applied. Because the number of times of polarity inversion per unit time for the dot inversion method is greater than that for the column inversion method, the dot inversion method consumes larger power, but provides a better quality of an image displayed than the column inversion method.

Figure 6:
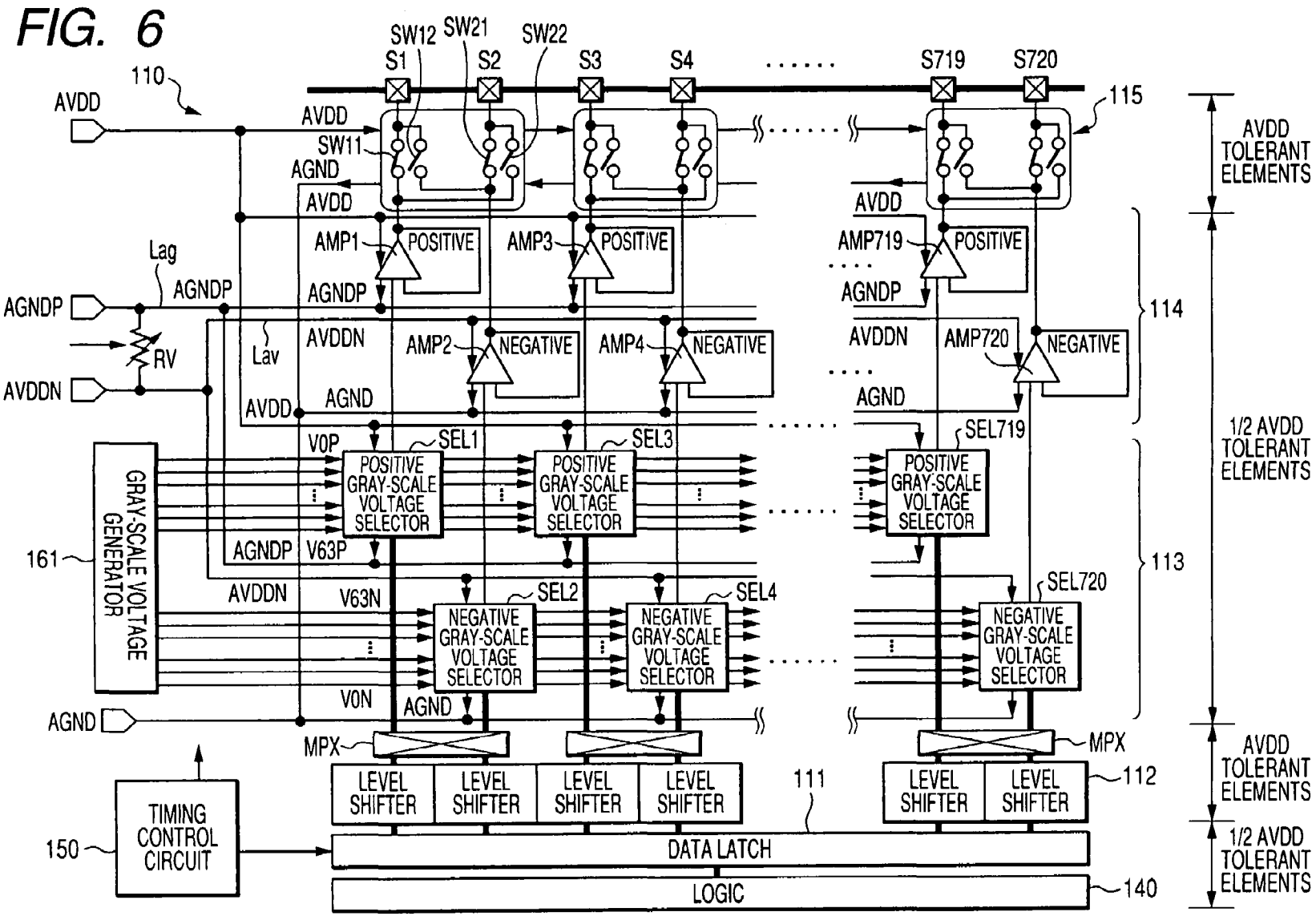
FIG. 6 is a block diagram showing an embodiment of a source driver circuit included in the liquid crystal display control driver to which the present invention is applied.

FIG. 6 shows one embodiment of the source driver circuit in the liquid crystal display control driver IC to which the present invention is applied. The circuit block shown in FIG. 6 is formed as a semiconductor integrated circuit on a single semiconductor chip like monocrystalline silicon.

The source driver circuit 110 of the present embodiment includes a data latch section 111 which sequentially takes in input image data from an internal logic section 140, a level shifter section 112 which level-shifts image data signals taken into the data latch section 111, a decoder section 113 which converts the image data into analog gray-scale voltages, and others. Also, the source driver circuit 110 includes an output amplification section 114 consisting of differential amplifiers AMP1 to AMP720, etc. which generate and output image signals Y1 to Y720 corresponding to the voltages as results of the conversion by the decoder section 113 and an AC output section 115 which alternately performs switching between a positive image signal and a negative image signal to be output from output terminals S1 to S720 to the external.

These circuits constituting the source driver circuit 110 are controlled to operate at predetermined timing by a timing control section 150 which generates internal control signals for making the internal circuits in the semiconductor chip operate according to predetermined order, based on a clock signal and a control signal which are input from the external. This timing control circuit 150 may be configured as a part of the controller 190 shown in FIG. 1 or as a separate entity from the controller 190.

The decoder section 113 consists of a plurality of selectors SL1 to SL720 which convert digital signals into analog gray-scale voltages by selecting a voltage corresponding to image data taken into and held by the data latch section 111 from among gray-scale voltages V0P to V63P and V0N to V63N generated by a gray-scale voltage generator circuit 161. The gray-scale voltage generator circuit 161 generates gray-scale voltages representing, for example, positive and negative 64 gray levels by dividing the stepped-up voltage VP, VN supplied from the voltage step-up circuit which is not shown by a ladder resistor. Each amplifier AMP1 to AMP720 in the output amplification section 114 consists of a voltage follower or the like which performs impedance conversion of an analog voltage as a result of the conversion by the decoder section 113

Among the above amplifiers AMP1 to AMP720, odd-ordered amplifiers AMP1, AMP3 . . . AMP 719 output positive image signals and even-ordered amplifiers AMP2, AMP4 . . . AMP 720 output negative image signals. The AC output section 115 is made up of 720 pairs of switches SW11, SW12; SW21, SW22, and so on, each switch pair switching between the amplifier for positive voltage and the amplifier for negative voltage for connection to the corresponding output terminals. By alternate connection of the amplifier for positive voltage to one of two adjacent output terminals and the amplifier for negative voltage to the other one of these terminals and vice versa, the amplifiers for positive voltage and negative voltage should be provided, respectively, by half the number of output terminals. Each switch SW11, SW12; SW21, SW22 may be formed by a single MOSFET (insulated gate type field effect transistor) or formed as a circuit in which a switch MOSFET is combined with a differential amplifier.

Because of the provision of the AC output section 115, accordingly, multiplexers MPXs are provided between the level shifter section 112 and the decoder section 113. Each multiplexer exchanges image data routed to two adjacent output terminals. However, these multiplexers can be dispensed with by exchanging image data routed to two adjacent terminals before being supplied to the data latch section 111. In the case of the dot inversion method, because reversing the exchange is required per line, the related processing becomes complicated. However, in the case of the column inversion method, because the data exchange is required per frame, the related processing is not so complicated.

In this embodiment, the amplifiers for positive voltage AMP1, AMP3 . . . AMP719 operate on supply voltages of AVDD and AGNDP and the amplifiers for negative voltage AMP2, AMP4 . . . AMP720 operate on supply voltages of AVDDN and AGND. The values of these supply voltages AVDD, AGNDP, AVDDN, and AGND are selected to fulfill the relation AVDD-AGNDP=AVDDN-AGND. Specifically, the supply voltage AVDD is set at, for example 12 V and AGND is set at the ground potential of 0 V. The supply voltages AGNDP and AVDDN are potentials of 6 V, about ½ of the AVDD, but they are supplied as separate supply voltages.

In the case of a conventional source line driver circuit, the amplifiers for positive voltage and the amplifiers for negative voltage generally operate on common supply voltages AVDD-AGND (12V-0V). On the other hand, the circuits such as the internal logic section 140 and the data latch section 111 were configured to operate on a supply voltage of 5 V or less. Therefore, the decoder section 113 as well as the output amplification section 114 had to be constructed with elements that withstand higher voltage than the elements constituting the internal logic section 140. However, in the semiconductor manufacturing technique that the Applicant is going to use, a high voltage tolerant element occupies a larger area than a low voltage tolerant element, as is shown in FIGS. 7A and 7B.

Figure 7A:
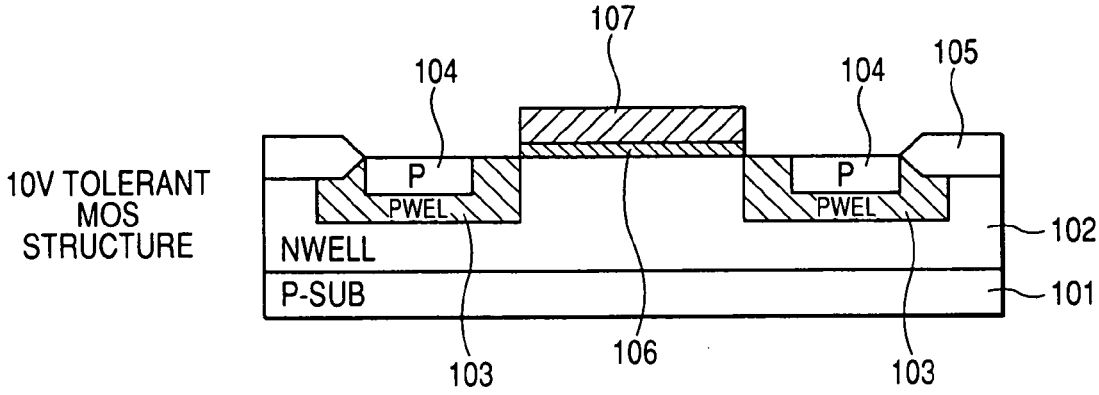
Figure 7B:
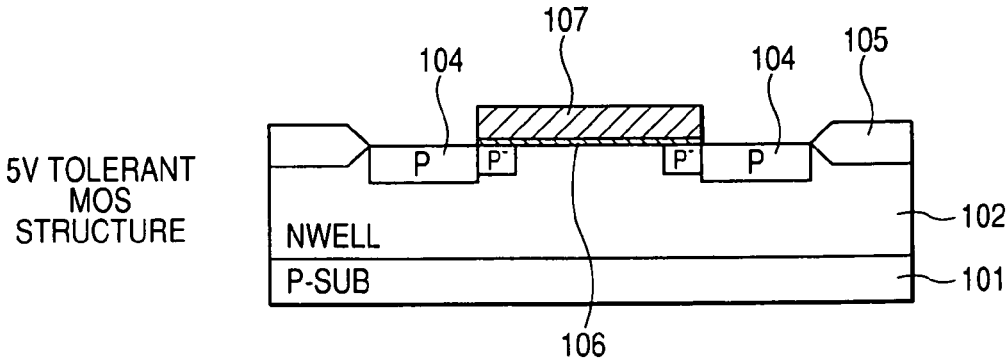

FIG. 7A shows the structure of a high voltage tolerant element and FIG. 7B shows the structure of a low voltage tolerant element. Reference numeral 101 denotes a monocrystalline silicon substrate, 102 denotes N-well regions which act as channel regions, 104 denotes diffusion layers which act as source-drain regions, 105 denotes an insulating layer for isolating elements, 106 denotes a gate insulating layer, and 107 denotes a polysilicon gate electrode. For the element shown in FIG. 7A, the diffusion layers 104 acting as the source-drain regions are formed over the well regions 103, separated from the edges of the gate electrode 107, and the gate insulating layer 106 is thicker than the gate insulating layer of the element shown in FIG. 7B which is a constituent of the internal logic. The element shown in FIG. 7A is thus configured to withstand a higher voltage.

Therefore, like the source line driver circuit of the present embodiment, when the amplifiers for positive voltage and the amplifiers of negative voltage are made to operate on the supply voltages that are a half the supply voltages used for the conventional circuit, the area occupied by the driver circuit can be decreased by using low voltage tolerant elements as the elements constituting the amplifiers and the decoder. Besides, as is apparent from FIG. 6, the source line driver circuit 110 includes several hundred output terminals and the corresponding number of the amplifiers (AMP) for output and the selectors (SEL), the area occupied by these circuits represents quite a large portion of the chip area. Thus, the effect of reducing the area occupied by the circuits and the chip size would be significantly great.

Figure 8A:
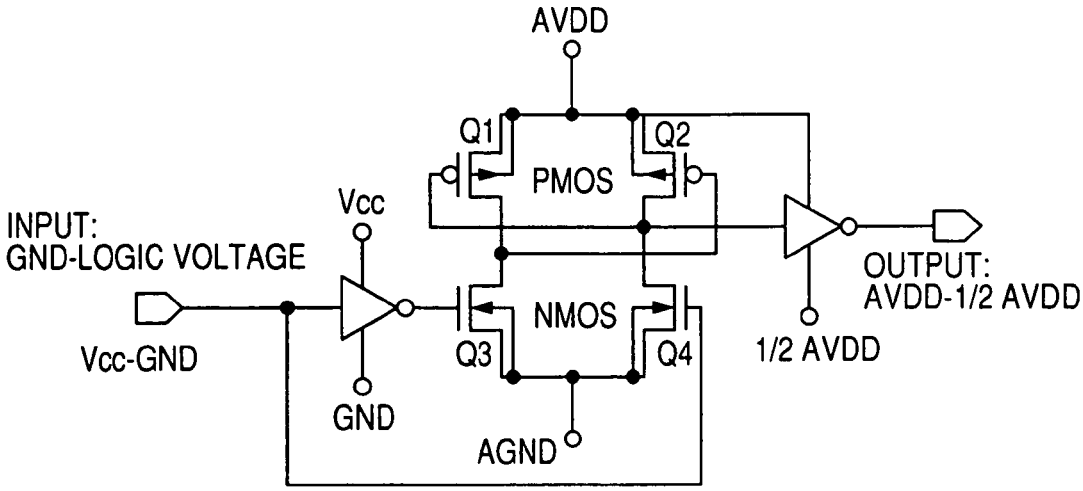
Figure 8B:
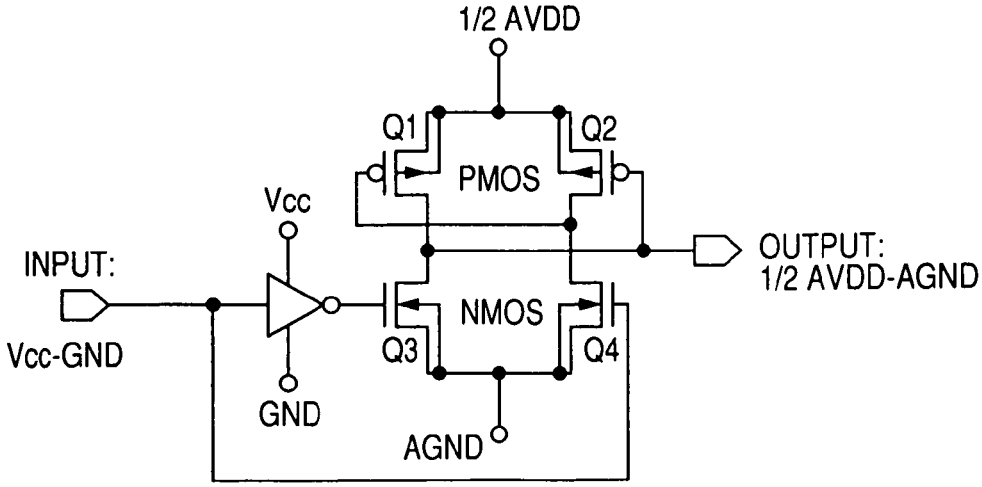

Among individual level shifter circuits constituting the level shifter section 112, the level shifter circuits for negative voltage can also be configured with low voltage tolerant elements. The reason for this is as follows. A level shifter circuit for positive voltage uses supply voltages AVDD-AGND with a large potential difference, as is shown FIG. 8A, and, therefore, high voltage tolerant elements must be used as transistors Q1 to Q4 constituting level shift stages. On the other hand, a level shifter circuit for negative voltage uses supply voltages AVDD/2-AGND with a small potential different, as is shown in FIG. 8B, and, therefore, low voltage tolerant elements can be used as transistors Q1 to Q4 constituting level shift stages.

Figure 9:
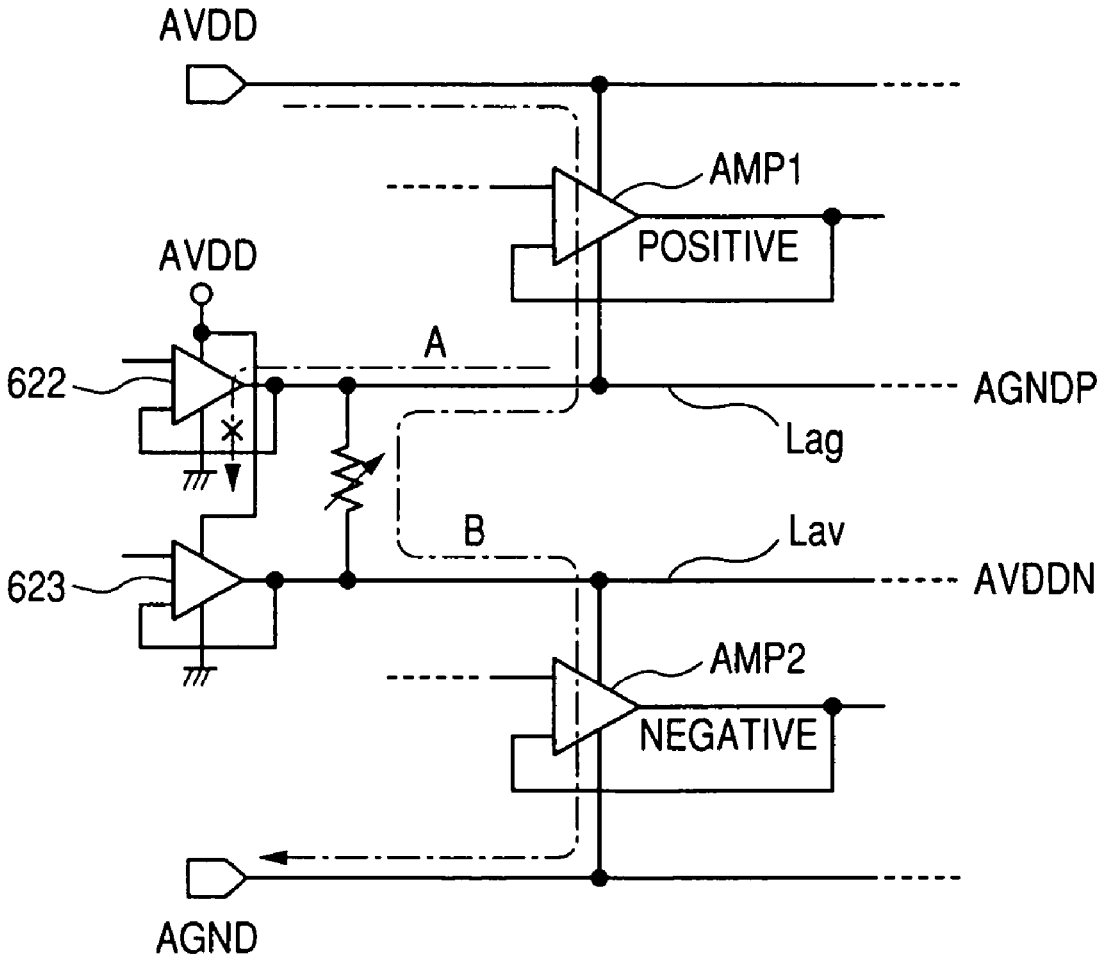
FIG. 9 is a circuit diagram illustrating current flow routes with and without a variable resistor Rv provided between power supply lines in the source driver circuit of the present embodiment.

In the present embodiment, furthermore, a variable resistor Rv is provided between power supply lines Lag and Lav which supply the supply voltages AGNDP and AVDDN, respectively. By the provision of the variable resistor Rv, current flowing through one amplifier can be fed to the power supply of the other amplifier and this can reduce the total power consumption. In the absence of the variable resistor Rv, current flowing through an amplifier AMP1 for positive voltage output flows through an element within an amplifier 622 which generates the supply voltage AGNDP to a ground point and its power is lost, as is indicated by a chain line A in FIG. 9. However, by the provision of the variable resistor Rv, the current flowing through the amplifier AMP1 for positive voltage output flows through the other amplifier AMP2 for negative voltage output, as is indicated by a chain line B in FIG. 9, and, consequently, power consumption can be reduced.

The above variable resistor Rv may be one whose resistance value changes by a voltage applied to it. In the present embodiment, however, a variable resistor circuit comprising a plurality of serial resistors and switch elements disposed in parallel with these resistors and configured so that the resistance value is varied by on/off control of the switch elements according to a setting value of the resistor is used. Although a fixed resistor can be used instead of the variable resistor Rv, which produces the same effect, by using a variable resistor element or variable resistor circuit, an optimum resistance value can be set, according to the potentials of the supply voltages AGNDP and AGDDN or the like.

Figure 10:
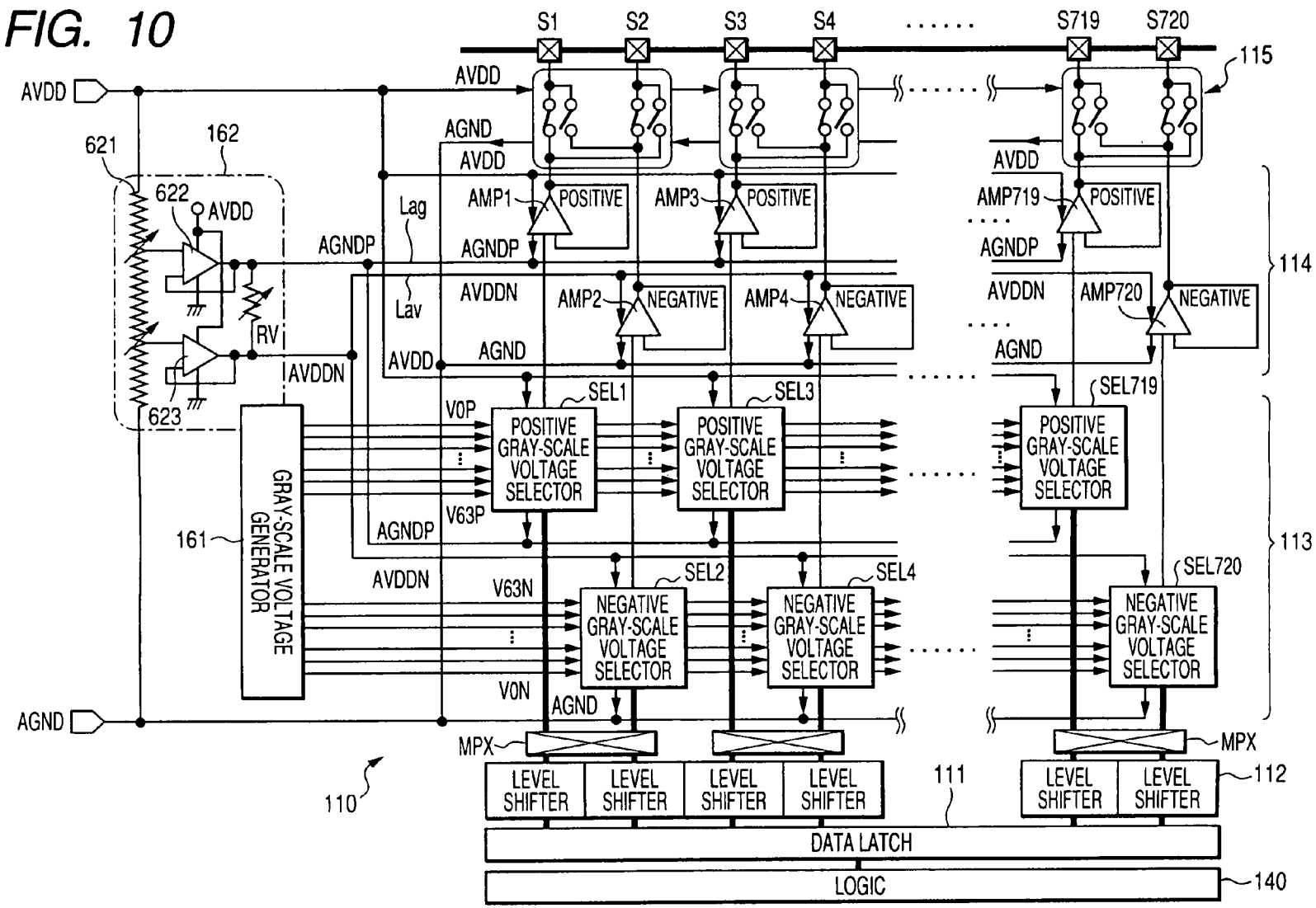
FIG. 10 is a circuit configuration diagram showing another embodiment of the source driver circuit in the liquid crystal display control driver IC to which the present invention is applied.

FIG. 10 shows another embodiment of the source driver circuit in the liquid crystal display control driver IC to which the present invention is applied. The liquid crystal display control driver of this embodiment includes a power supply circuit 162 on the chip. The power supply circuit generates the low supply voltage AGNDP which is used by the amplifiers for positive voltage, AMP1, AMP3 . . . AMP 719 and the high supply voltage AVDDN which is used by the amplifiers for negative voltage, AMP2, AMP4 . . . AMP 720.

This power supply circuit 162 comprises: a ladder resistor 621 connected between the supply voltage AVDD of 12V and the supply voltage AGND of 0 V; and voltage followers 622, 623 which output the power supply voltages AGNDP and AVDDN by impedance conversion of voltages resulting from dividing the input voltage by a resistance of the ladder resistor 622. In the present embodiment as well, the variable resistor Rv is provided between the power supply lines Lag and Lav which supply the supply voltages AGNDP and AVDDN. A fixed resistor may be used instead of the variable resistor.

While the invention made by the present inventors has been described specifically, based on its embodiments, it will be appreciated that the present invention is not limited to the embodiments described hereinbefore and various changes may be made without departing from the scope of the invention. For instance, in the foregoing embodiments, the gray-scale voltage generator circuit 161 that generates gray-scale voltages to be applied to the source lines of the liquid crystal panel is configured to generate positive and negative gray-scale voltages relative to the center potential determined to be a positive voltage VCOM. Alternatively, this circuit may be configured to use negative voltages as all or a part of negative gray-scale voltages by determining the center potential VCOM of the liquid crystal to be 0 V or a little higher voltage than 0 V.

The foregoing embodiments have illustrated the application of the invention to the IC called the liquid crystal display control driver including the scanning line driver circuit which applies gate signals to the gate lines, the controller which manipulates image data, and others in addition to the signal line driver circuit which generates drive voltages to be applied to the source lines of the liquid crystal panel. The present invention is not so limited and is applicable to, for example, an IC called a liquid crystal display driver comprising the circuits from the data latch section 11 to the AC output circuit 115, shown in FIG. 6, formed on a single semiconductor chip.

While, in the foregoing description, the invention made by the present inventors has been explained, focused on the liquid crystal display control driver that drives the TFT liquid crystal panel in which the electrode of a pixel is charged by a thin film transistor which is a three-terminal switching element in the background usage field of the invention, the present invention is not so limited and can be applied to other ones such as, for example, a liquid crystal display control driver that drives a MIM liquid crystal panel in which the electrode of a pixel is charged by a two-terminal switching element.

What is claimed is:

1. A semiconductor integrated circuit for driving a liquid crystal display including a driver circuit which generates and outputs drive signals which have gray-scale voltages corresponding to image data to be displayed and should be applied to signal lines of an active matrix type liquid crystal panel, said driver circuit comprising:

decoder circuits, each of which selects a gray-scale voltage corresponding to the image data;

first differential amplifier circuits which perform impedance conversion of positive voltages selected by said decoder circuits;

second differential amplifier circuits which perform impedance conversion of negative voltages selected by said decoder circuits; and switch circuits, each of which alternately conducts an output of said each first differential amplifier circuit to one of two adjacent output terminals and an output of said each second differential amplifier circuit to the other one of the two adjacent terminals and vice versa;

wherein said first differential amplifier circuits operate on a first supply voltage and a second supply voltage which is lower than the first supply voltage, and wherein said second differential amplifier circuits operate on a third supply voltage which is lower than said first supply voltage and a fourth supply voltage which is lower than the third supply voltage.

2. The semiconductor integrated circuit for driving a liquid crystal display according to claim 1, wherein elements constituting said first differential amplifier circuits and said second differential amplifier circuits and elements constituting said decoder circuits are designed to withstand a voltage lower than a voltage that elements constituting said switch circuits are designed to withstand.

3. The semiconductor integrated circuit for driving a liquid crystal display according to claim 1, wherein second switch circuits, each of which exchanges image data routed to two adjacent output terminals, are provided at preceding stages of said decoder circuits and the second switch circuits are controlled in relation to said switch circuits.

4. A semiconductor integrated circuit for driving a liquid crystal display including a driver circuit which generates and outputs drive signals which have gray-scale voltages corresponding to image data to be displayed and should be applied to signal lines of an active matrix type liquid crystal panel, said driver circuit comprising:

decoder circuits, each of which selects a gray-scale voltage corresponding to the image data;

first differential amplifier circuits which perform impedance conversion of positive voltages selected by said decoder circuits;

second differential amplifier circuits which perform impedance conversion of negative voltages selected by said decoder circuits; and switch circuits, each of which alternately conducts an output of said each first differential amplifier circuit to one of two adjacent output terminals and an output of said each second differential amplifier circuit to the other one of the two adjacent terminals and vice versa;

wherein said first differential amplifier circuits operate on a first supply voltage and a second supply voltage which is lower than the first supply voltage and said second differential amplifier circuits operate on a third supply voltage which is lower than said first supply voltage and a fourth supply voltage which is lower than the third supply voltage, and wherein a first power supply line which supplies said second supply voltage to said first differential amplifier circuits and a second power supply line which supplies said third supply voltage to said second differential amplifier circuits are connected via a resistor.

5. The semiconductor integrated circuit for driving a liquid crystal display according to claim 4, wherein said resistor is a variable resistor element or a variable resistor circuit whose resistance value is variable.

6. The semiconductor integrated circuit for driving a liquid crystal display according to claim 4, wherein said resistor is a fixed resistor having a constant resistance value.

7. The semiconductor integrated circuit for driving a liquid crystal display according to claim 4, further including a first power supply circuit which generates said second supply voltage and a second power supply circuit which generates said third supply voltage.

8. The semiconductor integrated circuit for driving a liquid crystal display according to claim 7, wherein said first power supply circuit and said second power supply circuit operate on said first supply voltage and said fourth supply voltage.

9. The semiconductor integrated circuit for driving a liquid crystal display according to claim 4, wherein elements constituting said first differential amplifier circuits and said second differential amplifier circuits and elements constituting said decoder circuits are designed to withstand a voltage lower than a voltage that elements constituting said switch circuits are designed to withstand.

10. The semiconductor integrated circuit for driving a liquid crystal display according to claim 9, wherein level shifter circuits, each of which level-shifts the potential of an image data signal to be decoded, are provided at preceding stages of said decoder circuits, and the level shifter circuits at the preceding stages of decoder circuits that select a positive gray-scale voltage among said decoder circuits are configured, comprising elements which are designed to withstand a voltage higher than a voltage that elements constituting decoder circuits which select a negative gray-scale voltage are designed to withstand.

* * * * *